US007175454B2

(12) United States Patent
Araki et al.

(10) Patent No.: US 7,175,454 B2
(45) Date of Patent: Feb. 13, 2007

(54) ROTARY CONNECTOR

(75) Inventors: Shunji Araki, Miyagi-ken (JP); Shu Chiba, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/256,418

(22) Filed: Oct. 20, 2005

(65) Prior Publication Data

US 2006/0089035 A1 Apr. 27, 2006

(30) Foreign Application Priority Data

Oct. 22, 2004 (JP) ..... 2004-308170

(51) Int. Cl.
*H01R 3/00* (2006.01)

(52) U.S. Cl. ..... 439/164; 439/15

(58) Field of Classification Search ..... 439/164, 439/15

See application file for complete search history.

(56) References Cited

U.S. PATENT DOCUMENTS 5,106,316 A 4/1992 Hiroyuki ..... 439/164

6,435,886 B2 8/2002 Oguma ..... 439/164

FOREIGN PATENT DOCUMENTS

| | | |
|---|---|---|
| EP | 0 401 028 | 12/1990 |
| EP | 0 895 900 | 8/1997 |
| EP | 1 180 831 | 2/2002 |
| JP | 2002-58150 | 2/2002 |
| JP | 2002-058150 | 2/2002 |

*Primary Examiner*—Javaid H. Nasri
(74) *Attorney, Agent, or Firm*—Brinks Hofer Gilson & Lione

(57) ABSTRACT

A rotary connector includes a stator housing including a bottom cover having a central hole and an outer cylindrical portion provided along the outer edge of the bottom cover; an upper rotor including an inner cylindrical portion and a top plate protruding outward from the top end thereof; a lower rotor inserted into the central hole and snap-fitted to the inner circumferential surface of the inner cylindrical portion; a holder rotatably disposed in an accommodation space defined between the upper rotor and the stator housing; a flat cable wounded and accommodated in the accommodation space with the winding direction thereof reversed at any point of the length; and a spacer fixed to the outer circumferential surface of the bottom part of the inner cylindrical portion. The spacer and the flange hold the edge of the bottom cover around the central hole.

4 Claims, 3 Drawing Sheets

ROTARY CONNECTOR

BACKGROUND OF THE INVENTION

1. Field of the Invention

The present invention relates to rotary connectors including a stator housing and a rotor housing that are rotatably coupled and electrically connected through a flexible cable, and particularly relates to a rotary connector including a rotor housing composed of upper and lower rotors coupled and integrated with, for example, a snap fit.

2. Description of the Related Art

Rotary connectors include, for example, a stator housing fixed to a combination switch assembly provided on a steering unit of an automobile, a rotor housing attached to a steering wheel, and a flexible cable wound in an annular accommodation space defined between the stator housing and the rotor housing. These rotary connectors are used to provide electrical connection for, for example, an airbag inflator provided on a steering wheel, which has a limited number of revolutions.

Among such rotary connectors is a known rotary connector according to, for example, Japanese Unexamined Patent Application Publication No. 2002-58150 (see Pages 5 and 6 and FIG. 2 of the publication). This rotary connector includes a rotor housing composed of upper and lower rotors which are integrated with a snap fit in the final stage of its assembly process so that the rotor housing is rotatably attached to a stator housing. FIG. 3 is a sectional view of an example of such a known rotary connector. This rotary connector mainly includes a stator housing 20, a rotor housing 21 rotatably attached to the stator housing 20, a holder 23 rotatably disposed in an annular accommodation space 22 defined between the housings 20 and 21, and a strip-like flat cable 24 wound and accommodated in the accommodation space 22.

The stator housing 20 includes an outer cylindrical portion 25 and a bottom cover 26 that are made of a synthetic resin and are integrated with, for example, a snap fit. A control wall 25*a* protrudes inward from the top end of the outer cylindrical portion 25, and a circular central hole 26*a* is formed in the center of the bottom cover 26. The rotor housing 21 includes an upper rotor 27 and a lower rotor 28 that are made of a synthetic resin. The upper rotor 27 includes an annular top plate 27*a* and an inner cylindrical portion 27*b* extending downward from the inner edge of the top plate 27*a*. The top plate 27*a* and the inner cylindrical portion 27*b* are integrally formed. The lower rotor 28 includes a cylindrical wall 28*a* and a flange 28*b* protruding outward from the bottom end of the cylindrical wall 28*a*. The cylindrical wall 28*a* and the flange 28*b* are integrally formed. The cylindrical wall 28*a* is snapped into the inner cylindrical portion 27*b* to integrate the upper rotor 27 and the lower rotor 28. In the integration of the upper rotor 27 and the lower rotor 28, the bottom surface of the outer edge of the top plate 27*a* of the upper rotor 27 is brought into contact with the top end of the control wall 25*a* of the outer cylindrical portion 25 while the flange 28*b* of the lower rotor 28 is brought into contact with the bottom surface of the edge of the bottom cover 26 around the central hole 26*a*. As a result, the rotor housing 21 is rotatably attached to the stator housing 20.

The accommodation space 22 is defined by the outer cylindrical portion 25 and bottom cover 26 of the stator housing 20 and the top plate 27*a* and inner cylindrical portion 27*b* of the rotor housing 21. This accommodation space 22 accommodates the holder 23 and the flat cable 24. The holder 23 includes rollers 23*a* and an annular rotary plate 23*b*. The rotary plate 23*b* is made of a synthetic resin and is rotatably placed on the top surface of the bottom cover 26. The rollers 23*a* are rotatably supported on the top surface of the rotary plate 23*b*, and openings of a predetermined size are defined between the rollers 23*a* adjacent in the circumferential direction. The accommodation space 22 accommodates the flat cable 24 with its winding direction reversed at any point of its length. The flat cable 24 turns around any of the rollers 23*a* on the holder 23. Lead blocks (not shown) are connected to the longitudinal ends of the flat cable 24. These lead blocks are fixed to predetermined positions of the outer cylindrical portion 25 and the upper rotor 27 so that the flat cable 24 is electrically connected to the outside of the housings 20 and 21.

For the rotary connector having the above structure, if the rotor housing 21 (the upper rotor 27 and the lower rotor 28) is rotated in either a forward or reverse direction with respect to the stator housing 20 (the outer cylindrical portion 25 and the bottom cover 26), the reversed portion of the flat cable 24 moves in the same direction by a smaller amount of rotation than the upper rotor 27, and the holder 23 moves in the same direction accordingly. As a result, the flat cable 24 is unwound from the inner cylindrical portion 27*b* of the upper rotor 27 to the outer cylindrical portion 25 or is wound around the inner cylindrical portion 27*b* of the upper rotor 27 from the outer cylindrical portion 25 by a length about twice the amount of movement.

The above known rotary connector holds the stator housing 20 and the rotor housing 21 in the axial direction by bringing the bottom surface of the outer edge of the top plate 27*a* into contact with the top end of the control wall 25*a* and the flange 28*b* of the lower rotor 28 into contact with the bottom surface of the edge of the bottom cover 26 around the central hole 26*a*. The rotor housing 21 may therefore be smoothly rotated with the contact surfaces sliding over each other if the dimensional accuracy of each member is maintained. However, the dimensional accuracy of the molded components constituting the stator housing 20 and the rotor housing 21 tends to decrease because the sliding surfaces of the top plate 27*a* and the control wall 25*a* are separated from the center of rotation of the rotor housing 21 by a large distance. In addition, the top plate 27*a* readily suffers, for example, dimensional variations and warping due to changes in ambient temperature. As a result, unfortunately, the sliding portions of the top plate 27*a* and the control wall 25*a* generate unusual noise when the rotor housing 21 is rotated.

SUMMARY OF THE INVENTION

In light of the above circumstances of the related art, an object of the present invention is to provide a rotary connector capable of inhibiting unusual noise generated from sliding portions.

To achieve the above object, a rotary connector according to the present invention includes a stator housing including a bottom plate having a central hole and an outer cylindrical portion provided along the outer edge of the bottom plate; an upper rotor rotatably coupled to the stator housing with an annular accommodation space defined therebetween and including a top plate opposite the bottom plate and an inner cylindrical portion opposite the outer cylindrical portion; a lower rotor that is inserted into the central hole and is fixed to the inner circumferential surface of the inner cylindrical portion and that has a flange overlapping with the outer surface of the bottom plate; a flexible cable accommodated in the accommodation space with the winding direction thereof reversed at any point of the length thereof and having ends electrically connected to the outside of the stator housing and the upper rotor; a holder rotatably disposed in the accommodation space and having an opening through which the reversed portion of the flexible cable passes; and a spacer fixed to the outer circumferential surface of the bottom part of the inner cylindrical portion. The spacer and the flange of the lower rotor hold the bottom plate.

In the rotary connector having the above structure, the edge around the central hole of the bottom plate, which is a component of the stator housing, is held between the spacer fixed to the outer circumferential surface of the bottom part of the inner cylindrical portion of the upper rotor and the flange of the lower rotor fixed to the inner circumferential surface of the inner cylindrical portion. Based on the holding portions, therefore, the integrated upper and lower rotors may be held in the axial direction with respect to the stator housing. Thus sliding surfaces serving as the base of the product may be positioned near the center of rotation, and accordingly they may be more readily maintained at high dimensional accuracy. This allows for the inhibition of the unusual noise generated from the sliding surfaces.

In the above structure, the spacer and the lower rotor are preferably made of a synthetic resin different from that for the bottom plate. This allows for a more effective reduction of the unusual noise generated from the sliding surfaces.

In the above structure, additionally, the lower rotor preferably has an annular fit portion formed in the center thereof. This annular fit portion is fittable to the outer circumferential surface of a steering shaft. The annular fit portion can hold the integrated upper and lower rotors in the radial direction of the stator housing.

DESCRIPTION OF THE PREFERRED EMBODIMENTS

Figure 1:
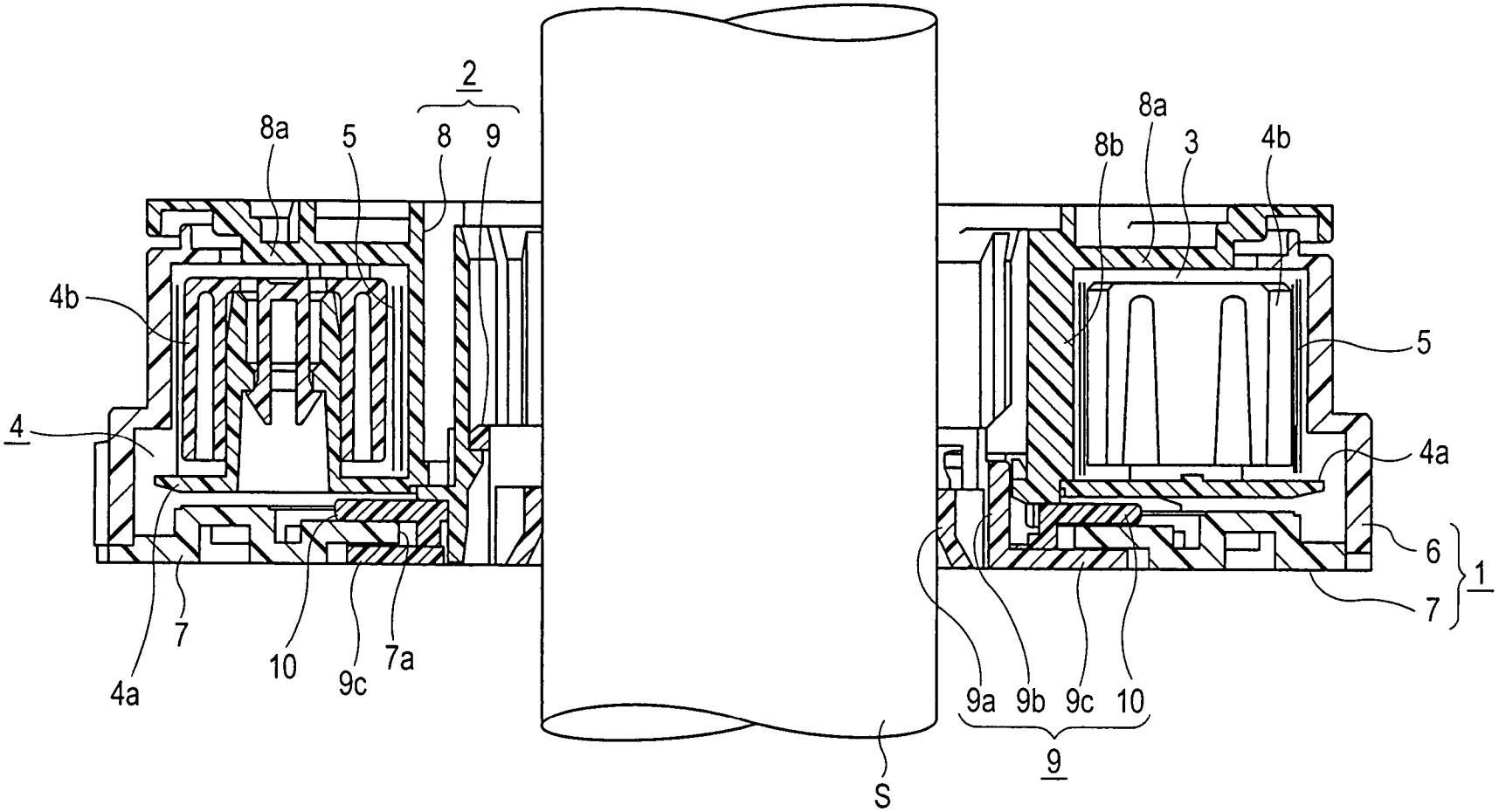
FIG. 1 is a sectional view of a rotary connector, attached to a steering shaft, according to an embodiment of the present invention.
Figure 2:
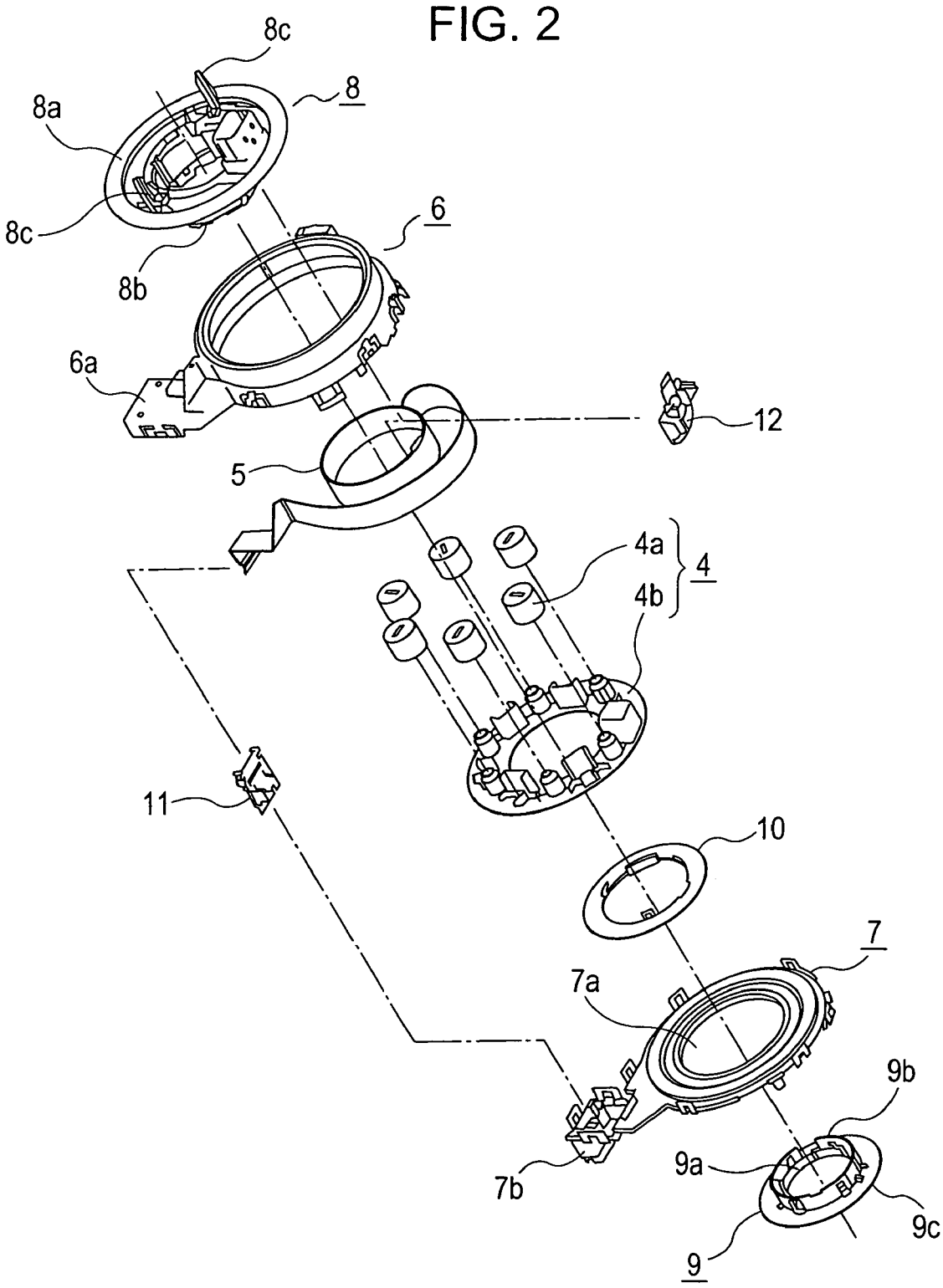
FIG. 2 is an exploded perspective view of the rotary connector.
Figure 3:
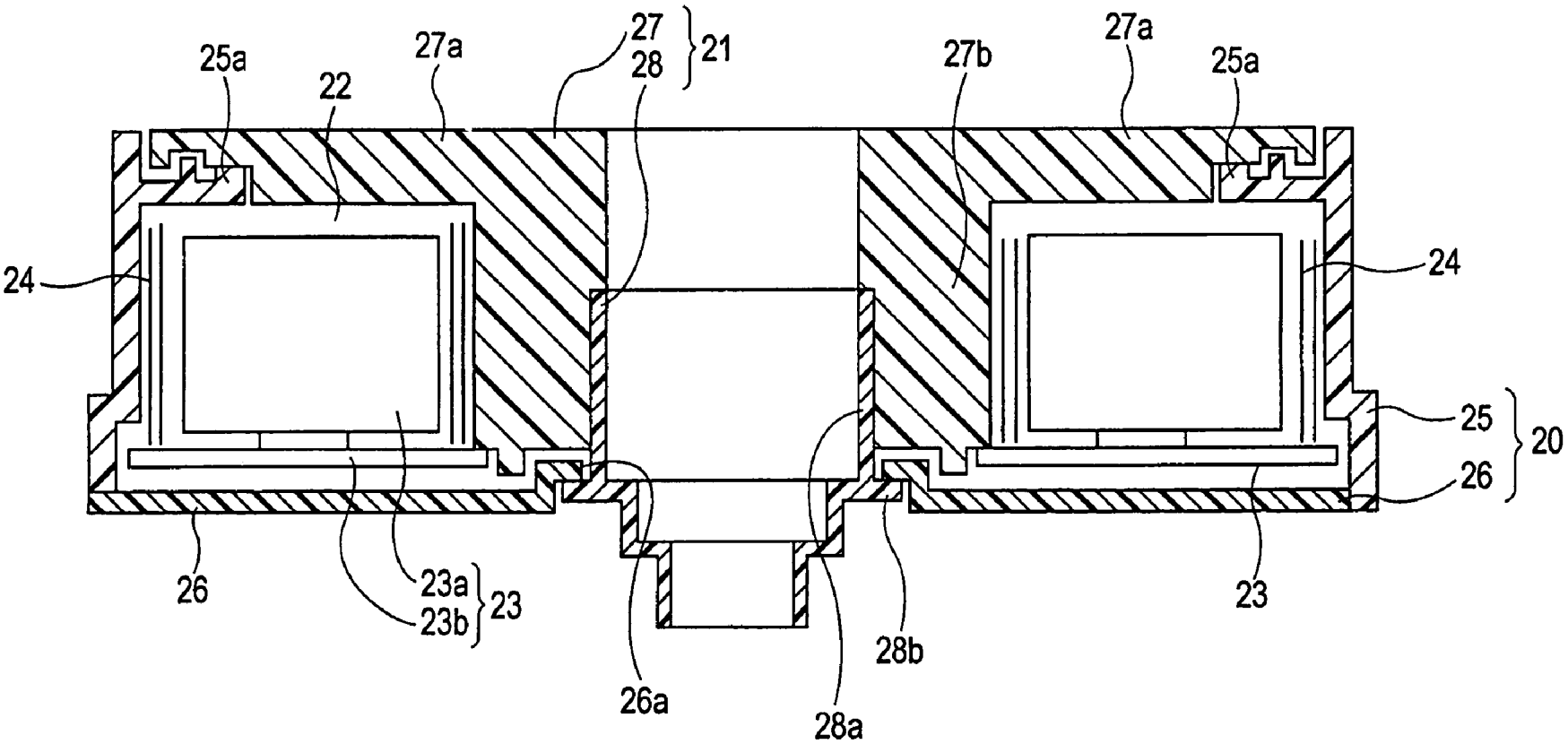
FIG. 3 is a sectional view of an example of a known rotary connector.

An embodiment of the present invention will now be described with reference to the drawings. FIG. 1 is a sectional view of a rotary connector, attached to a steering shaft, according to the embodiment of the present invention. FIG. 2 is an exploded perspective view of the rotary connector.

The rotary connector according to this embodiment mainly includes a stator housing 1, a rotor housing 2 rotatably attached to the stator housing 1, a holder 4 rotatably disposed in an annular accommodation space 3 defined between the housings 1 and 2, and a strip-like flat cable 5 wound and accommodated in the accommodation space 3.

The stator housing 1 includes an outer cylindrical portion 6 made of a synthetic resin, namely polyacetal (POM), and a bottom cover 7 made of another synthetic resin, namely polybutylene terephthalate (PBT). The outer cylindrical portion 6 and the bottom cover 7 are integrated with, for example, a snap fit. A lid 6*a* and attachment parts (not shown) are integrally formed on the outer circumferential surface of the outer cylindrical portion 6. The attachment parts are secured to, for example, a combination switch assembly of a steering unit with screws. The bottom cover 7 constitutes the bottom plate of the stator housing 1. Although the outer cylindrical portion 6 and the bottom cover 7 are separately formed and are integrated with a snap fit in this embodiment, they may also be integrally formed. A circular central hole 7*a* is formed in the center of the bottom cover 7, and a holding part 7*b* is integrally formed at the outer edge of the bottom cover 7.

The rotor housing 2 includes an upper rotor 8 made of a synthetic resin, namely polybutylene terephthalate (PBT), and a lower rotor 9 made of another synthetic resin, namely polypropylene (PP). The upper rotor 8 includes an annular top plate 8*a* and an inner cylindrical portion 8*b* extending downward from the inner edge of the top plate 8*a*. The top plate 8*a* and the inner cylindrical portion 8*b* are integrally formed. The bottom end of the inner cylindrical portion 8*b* is positioned inside the central hole 7*a* of the bottom cover 7. An annular spacer 10 is snapped onto the outer circumferential surface of the bottom part of the inner cylindrical portion 8*b*. This spacer 10 is made of a synthetic resin, namely polyacetal (POM), and has an outer diameter larger than the diameter of the central hole 7*a*. On the other hand, the lower rotor 9 includes an annular fit portion 9*a*, a cylindrical wall 9*b*, and a flange 9*c* that are integrally formed. A steering shaft S is fitted into the annular fit portion 9*a*, which is disposed at the innermost position. The cylindrical wall 9*b* is disposed concentrically outside the annular fit portion 9*a*. This cylindrical wall 9*b* is snapped into the inner cylindrical portion 8*b* through the central hole 7*a* to integrate the upper rotor 8 and the lower rotor 9. The flange 9*c* protrudes outward from the bottom end of the cylindrical wall 9*b* and has an annular shape with an outer diameter larger than the diameter of the central hole 7*a*. The spacer 10 and the flange 9*c* of the lower rotor 9 hold the edge of the bottom cover 7 around the central hole 7*a* so that the rotor housing 2 is rotatably attached to the stator housing 1 with the holding portions as sliding surfaces. The annular accommodation space 3 is defined between the outer cylindrical portion 6 and bottom cover 7 of the stator housing 1 and the top plate 8*a* and inner cylindrical portion 8*b* of the rotor housing 2. The outer cylindrical portion 6 faces the inner cylindrical portion 8*b* and the top plate 8*a* faces the bottom cover (bottom plate) 7 in the accommodation space 3. A drive pin 8*c* is provided on the top plate 8*a* of the upper rotor 8. This drive pin 8*c* is engaged with a steering wheel to transfer the torque of the steering wheel to the upper rotor 8.

The holder 4 includes rollers 4*a* and an annular rotary plate 4*b*. The rotary plate 4*b* is made of a synthetic resin, namely polypropylene (PP), and is rotatably placed on the bottom cover 7 in the accommodation space 3 with the outer circumferential surface of the bottom part of the inner cylindrical portion 8*b* as a guiding part. The rollers 4*a* are rotatably supported on the top surface of the rotary plate 4*b*, and openings of a predetermined size are defined between the rollers 4*a* adjacent in the circumferential direction. The accommodation space 3 accommodates the flat cable (flexible cable) 5 with its winding direction reversed at any point of its length. The reversed portion of the flat cable 5 is disposed in any of the openings on the holder 4. The longitudinal ends of the flat cable 5 are electrically connected to the outside of the housings 1 and 2, and lead blocks 11 and 12 are connected to the respective longitudinal ends. One lead block 11 is fixed in the holding part 7*b* of the bottom cover 7 and is covered with the lid 6*a* of the outer cylindrical portion 6 while the other lead block 12 is fixed inside a holding wall 8*d* provided on the top plate 8*a* of the upper rotor 8.

The rotary connector having the above structure is incorporated in a steering unit of an automobile. The stator housing 1 (the outer cylindrical portion 6 and the bottom cover 7) is fixed to, for example, a combination switch assembly, and the drive pin 8*c* of the upper rotor 8 is engaged with the steering wheel with the steering shaft S fitted into the annular fit portion 9*a* of the lower rotor 9.

In operation, when a driver rotates the steering wheel clockwise or counterclockwise, the resultant torque is transferred to the upper rotor 8 of the rotary connector through the drive pin 8*c* to rotate the rotor housing 2 (the upper rotor 8 and the lower rotor 9) clockwise or counterclockwise with respect to the stator housing 1. For example, if the upper rotor 8 is rotated clockwise from the neutral position of the steering wheel, the reversed portion of the flat cable 5 moves clockwise by a smaller amount of rotation than the upper rotor 8, and the holder 4, through which the reversed portion of the flat cable 5 passes, moves clockwise accordingly. As a result, the flat cable 5 is unwound from the outer circumferential surface of the inner cylindrical portion 8*b* to the inner circumferential surface of the outer cylindrical portion 6 by a length about twice the amount of movement. If, on the other hand, the upper rotor 8 is rotated counterclockwise from the neutral position of the steering wheel, the reversed portion of the flat cable 5 moves counterclockwise by a smaller amount of rotation than the upper rotor 8, and the holder 4 moves counterclockwise accordingly. As a result, the flat cable 5 is wound around the outer circumferential surface of the inner cylindrical portion 8*b* from the inner circumferential surface of the outer cylindrical portion 6 by a length about twice the amount of movement.

In the above embodiment, as described above, the spacer 10 is fixed to the outer circumferential surface of the bottom part of the inner cylindrical portion 8*b*, and the edge of the bottom cover 7 around the central hole 7*a* is held between the spacer 10 and the flange 9*c* of the lower rotor 9. The rotor housing 2 rotates with the contact portions of the spacer 10 and the bottom cover 7 and those of the flange 9*c* and the bottom cover 7 as sliding surfaces. Thus sliding surfaces serving as the base of the product may be positioned near the center of rotation, and accordingly they may be more readily maintained at high dimensional accuracy. This allows for the inhibition of unusual noise generated from the sliding surfaces. In addition, the bottom cover 7 is made of a synthetic resin different from those for the lower rotor 9 and the spacer 10 to effectively reduce unusual noise generated from the sliding surfaces of the bottom cover 7 and the spacer 10 and those of the bottom cover 7 and the flange 9*c*. Furthermore, the annular fit portion 9*a*, into which the steering shaft S is fitted, is formed in the center of the lower rotor 9. The annular fit portion 9*a* can hold the stator housing 1 and the rotor housing 2 in the radial direction. This simplifies the internal structure of the rotary connector.

What is claimed is:

1. A rotary connector comprising:

a stator housing including a bottom plate having a central hole and an outer cylindrical portion provided along an outer edge of the bottom plate;

an upper rotor rotatably coupled to the stator housing with an annular accommodation space defined therebetween, the upper rotor including a top plate opposite the bottom plate and an inner cylindrical portion opposite the outer cylindrical portion;

a lower rotor inserted into the central hole and fixed to an inner circumferential surface of the inner cylindrical portion, the lower rotor having a flange overlapping with an outer surface of the bottom plate;

a flexible cable accommodated in the accommodation space with a winding direction thereof reversed at any point of the length thereof, the flexible cable having ends electrically connected to an outside of the stator housing and the upper rotor;

a holder rotatably disposed in the accommodation space, the holder having an opening through which a reversed portion of the flexible cable passes; and a spacer fixed to an outer circumferential surface of the bottom part of the inner cylindrical portion, the spacer and the flange of the lower rotor holding the bottom plate.

2. The rotary connector according to claim 1, wherein the spacer and the lower rotor comprise a synthetic resin different from that for the bottom plate.

3. The rotary connector according to claim 1, wherein the lower rotor has an annular fit portion formed in the center thereof, the annular fit portion being fittable to an outer circumferential surface of a steering shaft.

4. The rotary connector according to claim 2, wherein the lower rotor has an annular fit portion formed in the center thereof, the annular fit portion being fittable to an outer circumferential surface of a steering shaft.

* * * * *